US006558239B2

(12) United States Patent
Kunisawa et al.

(10) Patent No.: US 6,558,239 B2
(45) Date of Patent: May 6, 2003

(54) POLISHING APPARATUS

(75) Inventors: Junji Kunisawa, Yamato (JP); Norio Kimura, Fujisawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/036,384

(22) Filed: Jan. 7, 2002

(65) Prior Publication Data

US 2002/0098787 A1 Jul. 25, 2002

(30) Foreign Application Priority Data

Jan. 9, 2001 (JP) ..... 2001-001832

(51) Int. Cl.[7] ..... B24B 21/00
(52) U.S. Cl. ..... 451/303; 451/307
(58) Field of Search ..... 451/303, 307, 451/388, 59, 44

(56) References Cited

U.S. PATENT DOCUMENTS 2,754,636 A * 7/1956 Creek
5,961,372 A * 10/1999 Shendon ..... 451/41
6,165,050 A * 12/2000 Ban et al. ..... 451/8
6,357,071 B2 * 3/2002 Moinpour et al. ..... 15/102
6,383,063 B1 * 5/2002 Ohashi et al. ..... 451/303
6,402,596 B1 * 6/2002 Hakomori et al. ..... 451/44

* cited by examiner

*Primary Examiner*—Eileen P. Morgan
(74) *Attorney, Agent, or Firm*—Wenderoth, Lind & Ponack, L.L.P.

(57) ABSTRACT

A polishing apparatus has a feed reel for feeding a polishing tape wound thereon and having a polishing surface, a take-up reel for reeling up the polishing tape from the feed reel, a presser for pressing the polishing tape between the feed reel and the take-up reel against a surface, to be polished, of a workpiece, and a motor for rotating the take-up reel. The feed reel, the take-up reel, and the presser are housed in a cartridge, which is detachably held by a cartridge holder.

14 Claims, 11 Drawing Sheets

POLISHING APPARATUS

BACKGROUND OF THE INVENTION

1. Field of the Invention

The present invention relates to a polishing apparatus, and more particularly to a polishing apparatus for polishing a surface of a workpiece such as a semiconductor substrate.

2. Description of the Related Art

More attempts are being made to use copper, which has a low electric resistivity and is highly resistant to electromigration, as a metal material for forming interconnections on a semiconductor substrate, rather than aluminum and aluminum alloys. Copper interconnections are generally formed by embedding copper in minute recesses defined in the surface of the semiconductor substrate. Chemical vapor deposition (CVD), sputtering, and plating processes are used to form copper interconnections. According to any of these processes, a copper film is deposited on the entire surface of the semiconductor substrate including a peripheral portion thereof while sealing the peripheral portion, and thereafter unwanted deposited copper is removed from the semiconductor substrate by chemical mechanical polishing (CMP). In this copper film growth process, when the sealing is incomplete, the copper film is deposited on a peripheral portion, i.e., an edge portion of the substrate, and a sputtered film of copper is attached to the reverse side of the substrate.

On the other hand, copper can easily be diffused into a silicon oxide film in a semiconductor fabrication process, impairing the electric insulation of the silicon oxide film. Thus, the remaining unnecessary copper needs to be completely removed from the substrate. Furthermore, the copper deposited upon film growth on the peripheral portion (edge portion and bevel portion) of the substrate other than the circuit area is unnecessary, and also may cause cross contamination in subsequent processes of delivering, storing, and processing the substrate. For these reasons, it is necessary that the remaining deposited copper on the peripheral portion of the substrate be completely removed immediately after the copper film growing process or the CMP process.

Defects and particles on the reverse side and bevel portion of the substrate may possibly cause microscratching in the CMP process, and dust attached to the reverse side of the substrate may drop onto a lower substrate in a carrier, causing defects on the lower substrate when a film is grown thereon. For these reasons, there is a growing need for the removal of defects and particles on the peripheral portion and reverse side of the substrate.

There have been made various attempts to remove copper defects from the peripheral portion and reverse side of a substrate. According to one attempt, while a substrate with a protective coating on the surface of a copper film deposited in the circuit area of the substrate is being rotated in a horizontal plane, a copper etching liquid is supplied to the peripheral portion of the substrate to dissolve and remove copper attached to the peripheral portion of the substrate. Another proposal is concerned with a process of immersing a substrate with a protective coating in an acid solution to etch away a metal film formed on the peripheral portion of the substrate. In still another approach, a silicon oxide film is formed on the surface of a substrate so as to entrap foreign matter and metal impurities, and then etched away from the surface of the substrate.

The above conventional processes of removing the unwanted deposits have an etching rate reduced depending on the types of film formed on the substrate, and cannot finish the etching process within a given period of time. If the temperature is raised to increase the etching rate in these conventional processes, then the equipment used becomes complex in structure for the need of increased resistance to chemicals and high temperatures.

SUMMARY OF THE INVENTION

The present invention has been made in view of the above drawbacks. It is therefore an object of the present invention to provide a polishing apparatus which has a compact structure and can effectively remove unwanted films and defects from a peripheral portion and reverse side of a substrate.

In order to achieve the above object, according to an aspect of the present invention, there is provided a polishing apparatus comprising: a feed reel for feeding a polishing tape wound thereon, the polishing tape having a polishing surface; a take-up reel for reeling up the polishing tape from the feed reel; a presser for pressing the polishing tape between the feed reel and the take-up reel against a surface, to be polished, of a workpiece; and a motor for rotating the take-up reel.

In this case, the presser may press the polishing tape against a side edge of the workpiece, or a reverse side of the workpiece, or a face side of the workpiece.

The polishing apparatus according to the present invention can effectively remove unwanted films and defects from the peripheral portion and reverse side of the workpiece, with a highly compact structure. The polishing apparatus can be used to polish not only the peripheral portion and reverse side of the workpiece, but also the face side (circuit area) of the workpiece such as a semiconductor substrate. In this case, the polishing apparatus can polish the face side of the substrate with more compact structure than a conventional CMP apparatus. Thus, the compactness of the polishing apparatus can be achieved.

According to a preferred aspect of the present invention, the polishing apparatus further comprises a cartridge housing the feed reel, the take-up reel, and the presser therein, and a cartridge holder for detachably holding the cartridge thereon.

According to another preferred aspect of the present invention, the polishing apparatus further comprises a cleaning unit for cleaning the polished surface of the workpiece and a drying unit for drying the workpiece which has been cleaned by the cleaning unit.

According to still another preferred aspect of the present invention, the polishing apparatus further comprises an inspection unit for inspecting the polished surface of the workpiece.

According to still another preferred aspect of the present invention, the polishing apparatus further comprises a vacuum chuck for holding the workpiece in such a state that a surface to be polished faces downwardly.

In this case, the vacuum chuck may comprise an annular vacuum seal on the peripheral portion thereof, and the vacuum seal may have a groove connected to a vacuum source.

According to still another preferred aspect of the present invention, the polishing apparatus further comprises a compression spring for biasing the presser toward the workpiece.

According to still another preferred aspect of the present invention, the presser comprises a bladder and a pressurized fluid supplied into the bladder.

The above and other objects, features, and advantages of the present invention will be apparent from the following description when taken in conjunction with the accompanying drawings which illustrates preferred embodiments of the present invention by way of example.

DETAILED DESCRIPTION OF THE PREFERRED EMBODIMENTS

A polishing apparatus according to embodiments of the present invention will be described below with reference to the accompanying drawings.

Figure 1:
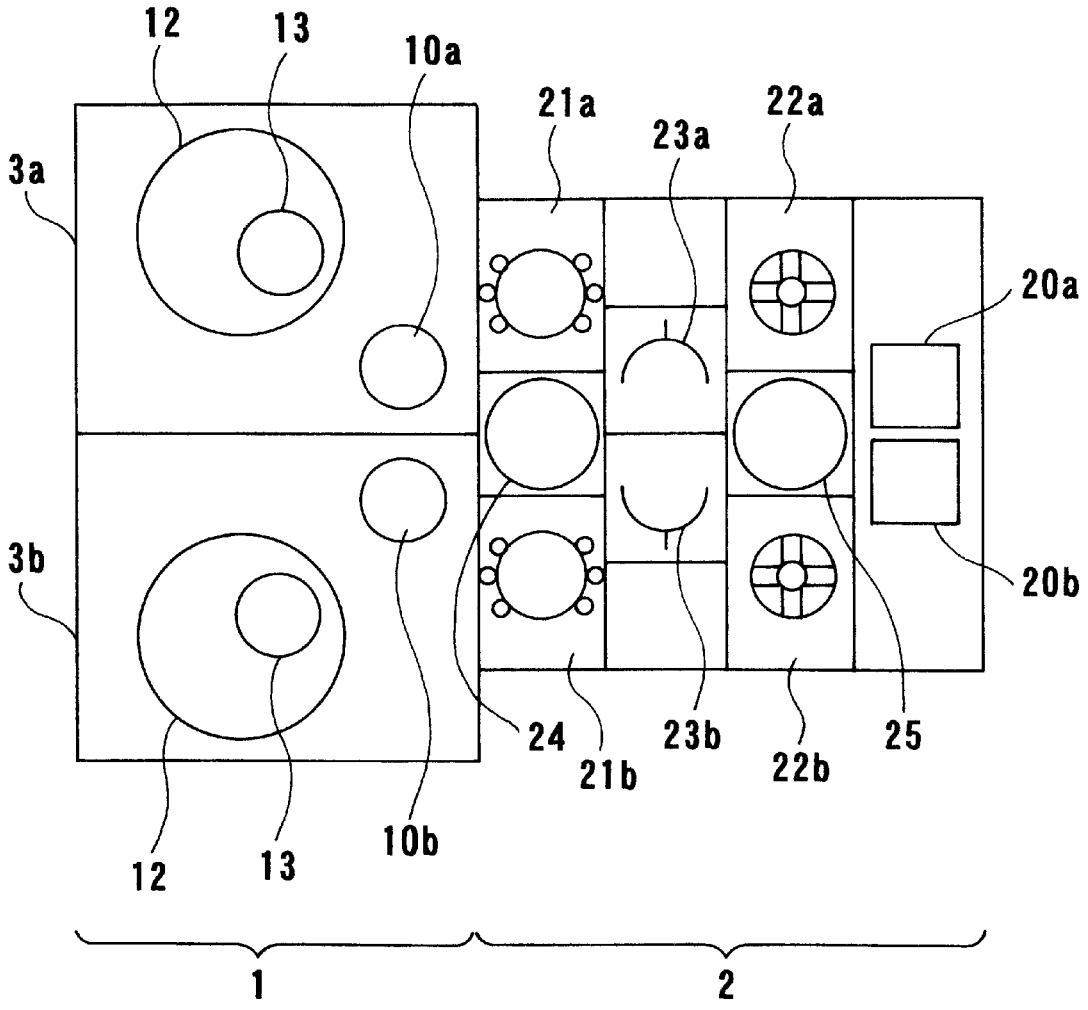
FIG. 1 a schematic view showing a whole arrangement of a polishing apparatus according to a first embodiment of the present invention.

FIG. 1 is a schematic view showing a whole arrangement of a polishing apparatus according to a first embodiment of the present invention. As shown in FIG. 1, the polishing apparatus generally has a polishing section 1 for polishing a workpiece such as a semiconductor substrate and a cleaning section 2 for cleaning the semiconductor substrate which has been polished in the polishing section 1.

The polishing section 1 comprises a pair of symmetrically arranged polishing units 3*a*, 3*b*. The polishing units 3*a*, 3*b* have substrate transfer tables 10*a*, 10*b* for loading substrates into and unloading substrates from the polishing section 1, respectively. The cleaning section 2 comprises a pair of loading/unloading units 20*a*, 20*b*, a pair of first cleaning units 21*a*, 21*b*, a pair of second cleaning units 22*a*, 22*b*, and a pair of inverters 23*a*, 23*b*.

The cleaning section 2 also includes a first transfer device 24 disposed between the first cleaning units 21*a*, 21*b* and a second transfer device 25 disposed between the second cleaning units 22*a*, 22*b*. The polishing section 1 and the cleaning section 2 are divided from each other by a partition wall to prevent contamination thereof. Particularly, the spaces in the polishing section 1 and the cleaning section 2 are air-conditioned and controlled in pressure in order to prevent a dirty environment in the polishing section 1 from diffusing in the cleaning section 2 which performs a cleaning process.

The polishing units 3*a*, 3*b*, the substrate transfer tables 10*a*, 10*b*, the loading/unloading units 20*a*, 20*b*, the first cleaning units 21*a*, 21*b*, the second cleaning units 22*a*, 22*b*, and the inverters 23*a*, 23*b* are identical in structure to each other, respectively. Thus, the polishing apparatus can concurrently perform two independent polishing processes, for example. Basically, only the polishing unit 3*a*, the substrate transfer table 10*a*, the loading/unloading unit 20*a*, the first cleaning unit 21*a*, the second cleaning unit 22*a*, and the inverter 23*a* will be described below in detail. However, the following description is applicable to the polishing unit 3*b*, the substrate transfer table 10*b*, the loading/unloading unit 20*b*, the first cleaning unit 21*b*, the second cleaning unit 22*b*, and the inverter 23*b*.

Figure 2:
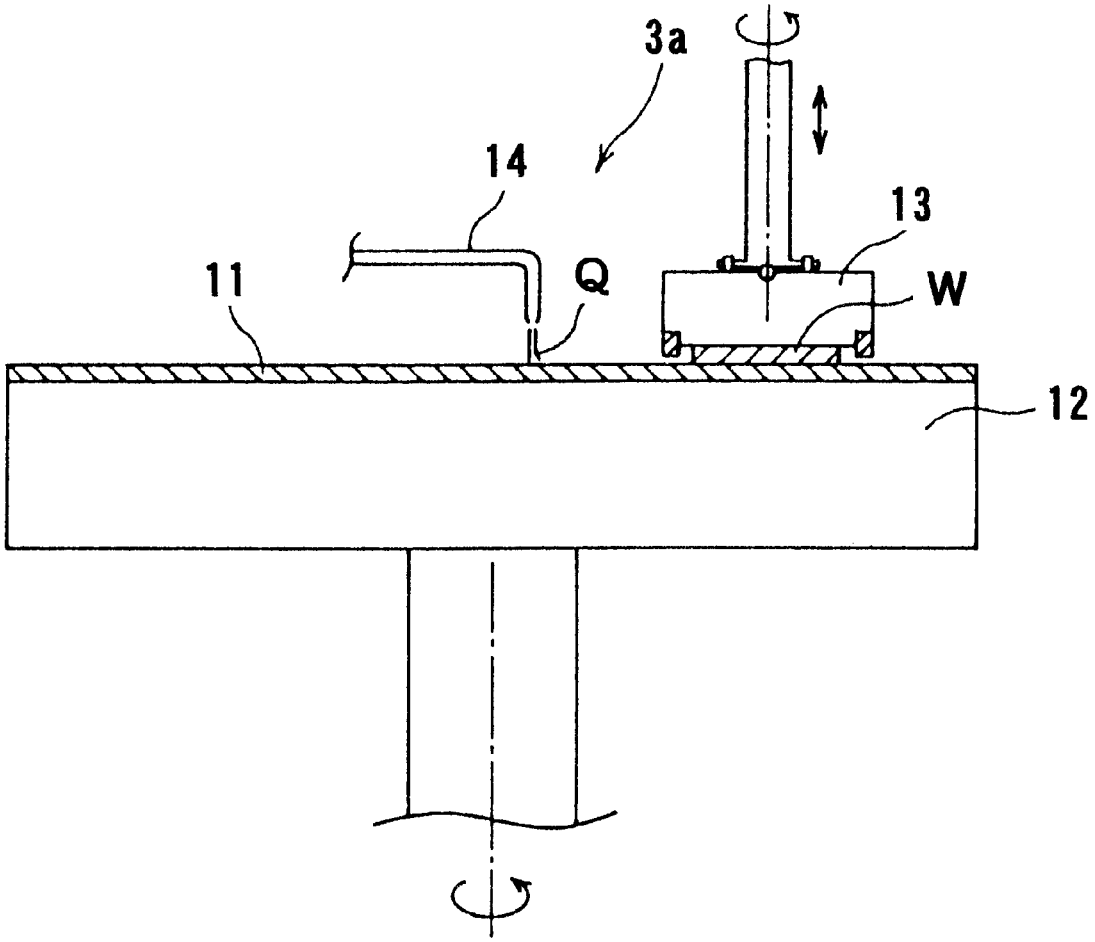
FIG. 2 is a vertical cross-sectional view showing a main part of a polishing, unit in a polishing section of the polishing apparatus shown in FIG. 1.

FIG. 2 is a vertical cross-sectional view showing a main part of the polishing unit 3*a* in the polishing section 1. As shown in FIG. 2, the polishing unit 3*a* comprises a polishing table 12 having a polishing cloth 11 attached thereon and constituting a polishing surface, a top ring 13 for holding a workpiece W to be polished, such as a semiconductor wafer (substrate), under vacuum and pressing the substrate W against the polishing table 12 to polish the substrate W, and a polishing liquid supply nozzle 14 for supplying a polishing liquid Q between the polishing cloth 11 and the substrate W.

Figure 3A:
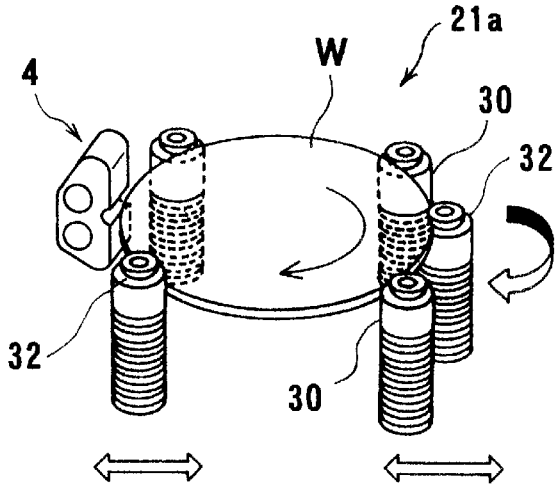
FIGS. 3A, 3B, and 3C are schematic views showing a first cleaning unit in a cleaning section of the polishing apparatus shown in FIG. 1.
Figure 3B:
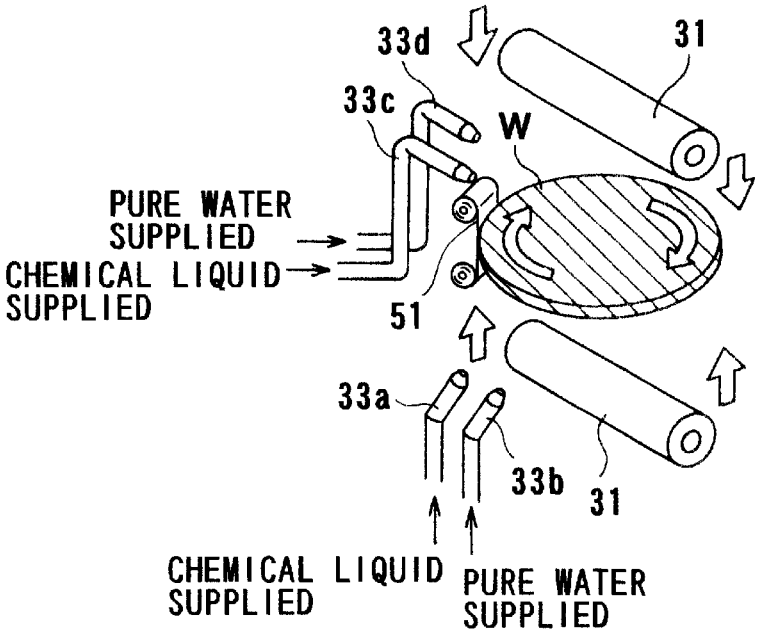
Figure 3C:
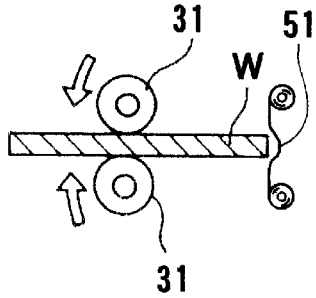

FIGS. 3A through 3C are schematic views showing the first cleaning unit 21*a* in the cleaning section 2. As shown in FIGS. 3A through 3C, the first cleaning unit 21*a* comprises a dual-roller low-speed-rotation cleaning unit, which has a plurality of vertical rollers 30 for holding the substrate W and roller-type cleaning elements 31 made of sponge or the like for scrubbing the surfaces of the substrate W.

As shown in FIG. 3A, the rollers 30 are radially movable and rotatable about their own axes. These rollers 30 are disposed around the substrate W so as to surround the substrate W. Each of the rollers 30 has a gripping groove 32 formed in an upper portion thereof for receiving the peripheral portion of the substrate W therein to hold the substrate W on the rollers 30. When the rollers 30 are rotated about their own axes, the substrate W held by the rollers 30 is rotated about its center.

As shown in FIG. 3B, the cleaning elements 31 of the first cleaning unit 21*a* are vertically movable and are disposed respectively above and below the substrate W. The cleaning elements 31 can be brought into contact with the surfaces of the substrate W by their vertical movement. In the first cleaning unit 21*a*, there are provided a chemical liquid supply nozzle 33*a* for supplying an etching liquid to the reverse side of the substrate W, a pure water supply nozzle 33*b* for supplying pure water to the reverse side of the substrate W, a chemical liquid supply nozzle 33*c* for supplying an etching liquid to the face side of the substrate W, and a pure water supply nozzle 33*d* for supplying pure water to the face side of the substrate W. As shown in FIG. 3A, the first cleaning unit 21*a* also has a tape polishing device 4 for polishing the peripheral portion of the substrate W after the substrate W has been polished in the polishing unit 3*a*. Details of the tape polishing device 4 will be described later on.

Figure 4A:
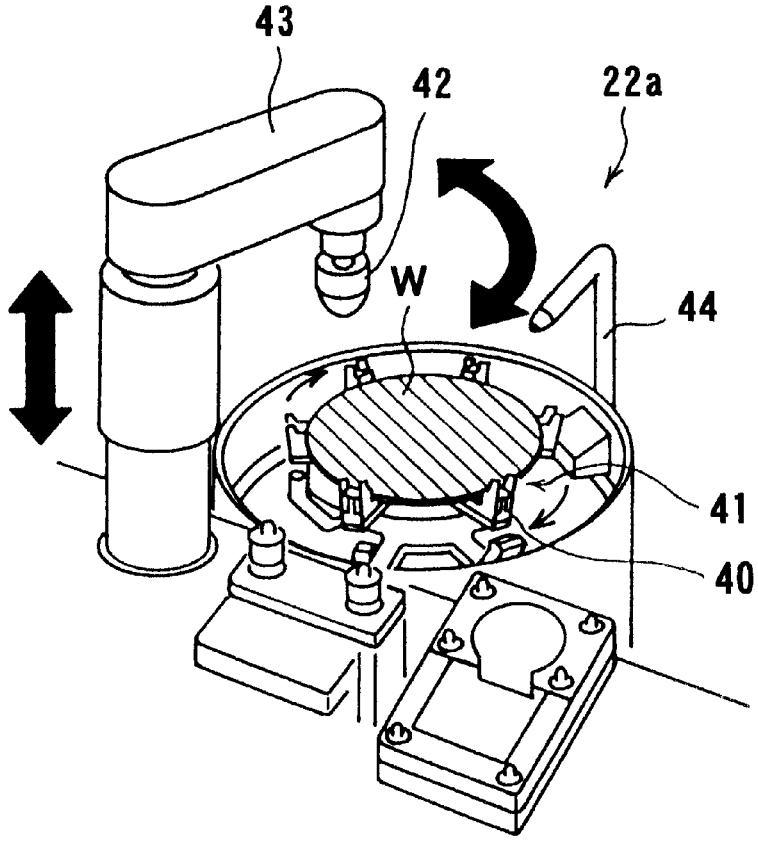
FIGS. 4A and 4B are schematic views showing a second cleaning unit in the cleaning section of the polishing apparatus shown in FIG. 1.
Figure 4B:
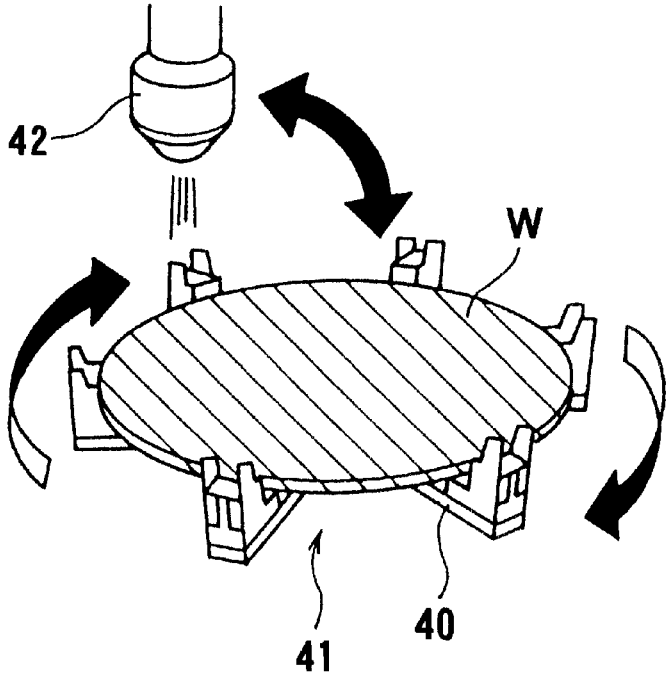

FIGS. 4A and 4B are schematic views showing the second cleaning unit 22*a* in the cleaning section 2. As shown in FIG. 4B, the second cleaning unit 22*a* comprises a rotating table 41 having a plurality of arms 40 for holding the substrate W. The arms 40 are mounted on and extended radially outwardly from the upper end of a rotatable shaft (not shown). The rotating table 41 can rotate the substrate W at high speeds ranging from 1500 to 5000 rpm.

As shown in FIG. 4A, a swing arm 43 having a nozzle 42 is provided in the second cleaning unit 22*a*. An ultrasonically vibrated cleaning liquid, e.g., pure water, is supplied from the nozzle 42 onto the upper surface of the substrate W. Thus, the second cleaning unit 22*a* comprises a megasonic high-speed-rotation cleaning unit.

The second cleaning unit 22*a* also has a gas nozzle 44 for supplying an inert gas and a heating device (not shown) for heating the substrate W to dry the substrate W for the purpose of improving the process performance and shortening the tact time.

Figure 5:
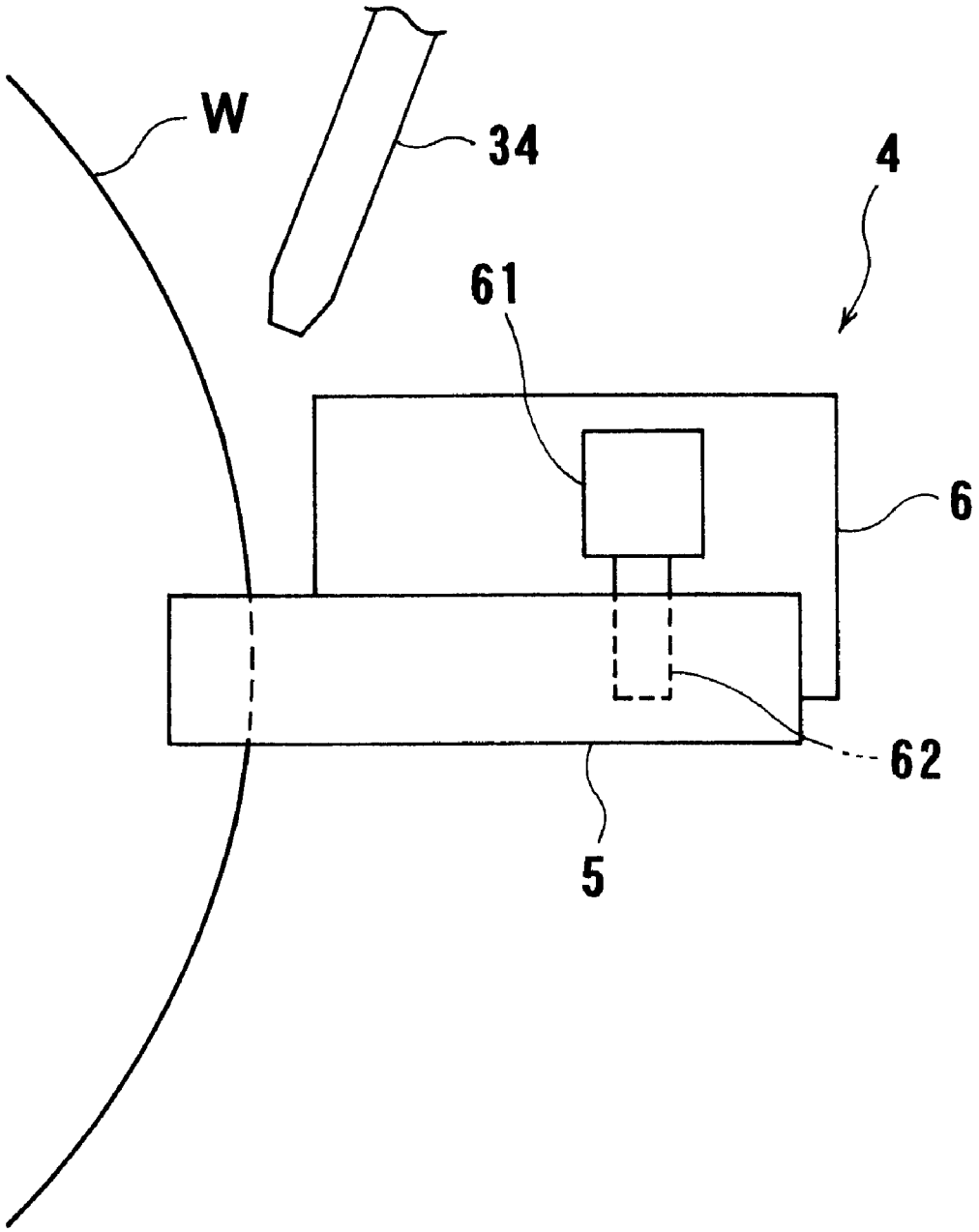
FIG. 5 is a plan view showing a tape polishing device according to the first embodiment of the present invention.

The tape polishing device 4 in the first cleaning unit 21*a* will be described in detail below. FIG. 5 is a plan view showing the tape polishing device 4 according to the present embodiment, and FIG. 6 is a vertical cross-sectional view showing a polishing cartridge of the tape polishing device 4.

The tape polishing device 4 is positioned within the first cleaning unit 21*a*, and is movable in the radial direction of the substrate W. The tape polishing device 4 mainly comprises a longitudinal polishing cartridge 5 having a substantially trapezoidal casing 50 which houses a thin polishing tape 51, and a cartridge holder 6 for detachably holding the polishing cartridge 5 thereon. Since the polishing cartridge 5 is detachably held by the cartridge holder 6, the polishing cartridge 5 can be replaced with a new one as needed.

The polishing tape 51 housed in the casing 50 comprises a base film of urethane, polyester, or the like which is coated with abrasive particles of aluminum oxide, silicon carbide, chromium oxide, diamond, or the like. The polishing tape 51 constitutes a polishing surface. For example, Imperial Lapping Films #2000 through #20000, manufactured by 3M, are suitable for use as the polishing tape 51. The polishing tape 51 should preferably have a width ranging from 5 to 20 mm.

Figure 6:
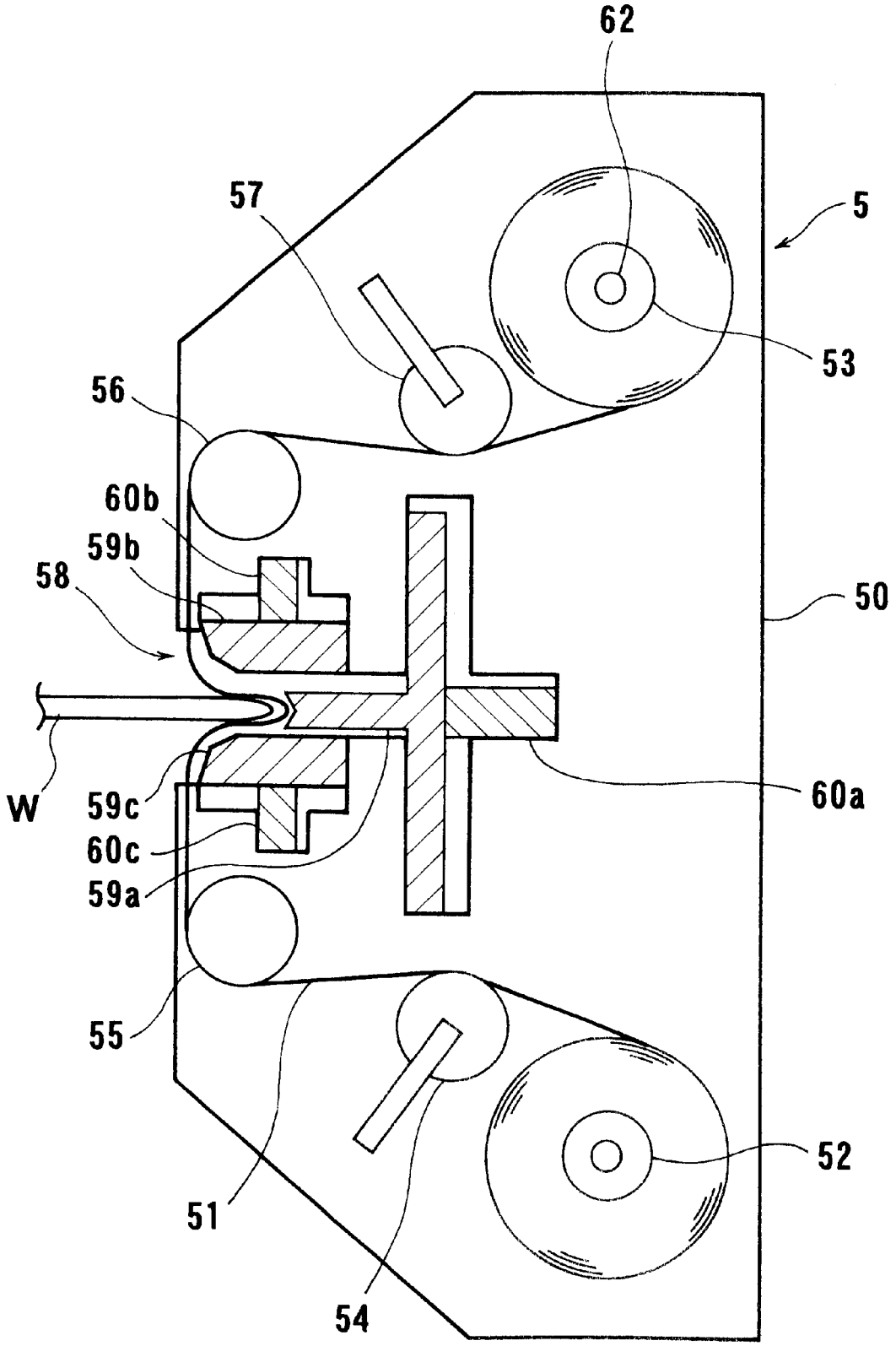
FIG. 6 is a vertical cross-sectional view showing a polishing cartridge of the tape polishing device shown in FIG. 5.

As shown in FIG. 6, the casing 50 accommodates therein a feed reel 52 with the polishing tape 51 wound thereon, a take-up reel 53 for reeling up the polishing tape 51 from the feed reel 52, and four rollers 54 through 57. The polishing tape 51 unreeled from the feed reel 52 is guided by the rollers 54, 55, 56 and 57 and wound around the take-up reel 53.

The polishing cartridge 5 has a recess 58 defined in a side portion thereof for receiving the peripheral portion of the substrate W. A portion of the polishing tape 51 between the rollers 55, 56 is exposed in the recess 58. In the recess 58, there are disposed a presser 59*a* for pressing the polishing tape 51 against the side edge of the substrate W, a presser 59*b* for pressing the polishing tape 51 against the face side of the peripheral portion of the substrate W, and a presser 59*c* for pressing the polishing tape 51 against the reverse side of the peripheral portion of the substrate W. The pressers 59*a*, 59*b*, 59*c* are biased toward the substrate W by respective compression springs 60*a*, 60*b*, 60*c*. These compression springs 60*a*, 60*b*, 60*c* may be replaced with other resilient members or air actuators.

As shown in FIG. 5, a motor 61 having a shaft 62 is mounted on the cartridge holder 6. In the case where the polishing cartridge 5 is held by the cartridge holder 6, the shaft 62 of the motor 61 is held in engagement with the takeup reel 53 of the polishing cartridge 5. When the motor 61 is energized, the shaft 62 of the motor 61 rotates the take-up reel 53 to reel up the polishing tape 51 wound on the feed reel 52.

When the tape polishing device 4 is moved toward the center of the substrate W, the peripheral portion of the substrate W is inserted into the recess 58 in the polishing cartridge 5, together with a portion of the polishing tape 51 between the rollers 55, 56. The pressers 59*a*, 59*b*, 59*c* are pushed by the inserted substrate W, so that the polishing tape 51 is pressed respectively against the side edge of the substrate W and the upper and lower surfaces of the peripheral portion of the substrate W. For example, the polishing tape 51 is pressed against the side edge of the substrate W and the upper and lower surfaces of the substrate W up to several millimeters radially inwardly from the side edge of the substrate W. In this state, the motor 61 is energized to rotate the take-up reel 53 to reel up the polishing tape 51. As a result, while the polishing tape 51 which is being pressed by the pressers 59*a*, 59*b* 59*c* is brought into sliding contact with the side edge of the substrate W and the upper and lower surfaces of the peripheral portion of the substrate W, the polishing tape 51 is reeled up by the take-up reel 53 to polish the side edge of the substrate W and the upper and lower surfaces of the peripheral portion of the substrate W with the abrasive particles attached thereon.

A process of polishing a workpiece such as a semiconductor substrate with the polishing apparatus thus constructed will be described below.

When a substrate cassette accommodating substrates with thin films deposited thereon is placed on the loading/unloading unit 20*a*, the second transfer device 25 takes up a substrate W from the substrate cassette. The second transfer device 25 transfers the substrate W to the inverter 23*a*, in which the substrate W is reversed upside down. The reversed substrate W is transferred to the substrate transfer table 10*a* in the polishing section 1 by the first transfer device 24 and placed on the substrate transfer table 10*a*.

The substrate W on the substrate transfer table 10*a* is held by the top ring 13 in the polishing unit 3*a*, and moved above the polishing table 12. Then, the polishing liquid Q is supplied from the polishing liquid supply nozzle 14 onto the polishing cloth 11. For polishing an insulating film (oxide film) on a silicon substrate, the polishing liquid Q may be an alkaline aqueous solution containing suspended abrasive particles of given diameter. In this state, the polishing table 12 and the top ring 13 are rotated independently of each other, and the substrate W held by the top ring 13 is pressed against the polishing cloth 11 to polish the substrate W with chemical mechanical polishing effect. The substrate W polished with the chemical mechanical polishing effect is then moved onto the substrate transfer table 10*a* and transferred to the first cleaning unit 21*a* by the first transfer device 24.

In the first cleaning unit 21*a*, the substrate W is held by the rollers 30 and rotated at low speeds ranging from several tens to 300 rpm. The tape polishing device 4 with the polishing cartridge 5 loaded therein is moved toward the center of the substrate W, so that the peripheral portion of the substrate W is inserted into the recess 58 in the polishing cartridge 5. As described above, the motor 61 is then energized to polish the side edge of the substrate W and the upper and lower surfaces of the peripheral portion of the substrate W by the polishing tape 51. While the substrate W is being thus polished by the polishing tape 51, pure water or a chemical liquid is supplied to the peripheral portion of the substrate W from a nozzle 34 disposed near the tape polishing device 4 (see FIG. 5).

When the polishing process of the side edge and peripheral portion of the substrate W is completed, the tape polishing device 4 is retracted radially outwardly away from the substrate W. Then, the upper and lower roller sponges (cleaning elements) 31 are moved downwardly and upwardly, respectively, into contact with the upper and lower surfaces, respectively, of the substrate W. Pure water is supplied from the upper and lower pure water supply nozzles 33*d*, 33*b* to scrub the entire upper and lower surfaces of the substrate W. The side edge and peripheral portion of the substrate W may be polished by the tape polishing device 4 in this primary cleaning process.

After the substrate W has been scrubbed, the upper and lower roller sponges 31 are retracted upwardly and downwardly, respectively. Then, an etching liquid is supplied from the upper and lower chemical liquid supply nozzles 33*c*, 33*a* to the upper and lower surfaces, respectively, of the substrate W for etching (chemically cleaning) the upper and lower surfaces of the substrate W to remove metal ions remaining thereon. At this time, the rotational speed of the substrate W may be varied as needed. Thereafter, pure water is supplied from the upper and lower pure water supply nozzles 33*d*, 33*b* to the upper and lower surfaces of the substrate W for replacing the etching liquid with the pure water to remove the etching liquid from the upper and lower surfaces of the substrate W. At this time, the rotational speed of the substrate W may also be varied as needed.

After the substrate W has been polished and scrubbed in the first cleaning unit 21*a*, the substrate W is transferred by the first transfer device 24 to the inverter 23*a*, in which the substrate W is reversed upside down. The substrate W reversed by the inverter 23*a* is then transferred to the second cleaning unit 22*a* by the second transfer device 25.

In the second cleaning unit 22*a*, the substrate W is held by the rotating table 41 and rotated at low speeds ranging from 100 to 500 rpm. The swing arm 43 is angularly moved over the entire upper surface of the substrate W in such a state that ultrasonically vibrated pure water is supplied to the substrate W from the nozzle 42 mounted on the swing arm 43, so that particles are removed from the upper surface of the substrate W. After the removal of particles from the substrate W is completed, the supply of the ultrasonically vibrated pure water from the nozzle 42 is stopped, and the swing arm 43 is moved back to its standby position. Then, the substrate W is rotated by the rotating table 41 at high speeds ranging from 1500 to 5000 rpm to spin-dry the substrate W. A clean inert gas may be supplied from the gas nozzle 44 as needed. A pencil-shaped cleaning member of sponge or the like may be used instead of or in addition to the ultrasonically vibrated pure water supplied to the substrate W in this cleaning process. This pencil-shaped cleaning member is held in contact with the substrate W and scanned to clean the substrate W.

After the substrate W has been cleaned and dried in the second cleaning unit 22*a*, the substrate W is returned into the substrate cassette on the loading/unloading unit 20*a* by the second transfer device 25.

The tape polishing device 4 in the polishing apparatus has a highly compact structure and can effectively remove unwanted films and defects from the peripheral portion and reverse side of the substrate. According to the present invention, the polishing surface is constituted by the deformable thin polishing tape pressed against the side edge and peripheral portion of the substrate, rather than a hard polishing surface. Accordingly, the polishing tape is deformed according to the shape of the substrate to simultaneously polish the side edge of the substrate and the upper and lower surfaces of the peripheral portion of the substrate.

A polishing apparatus according to a second embodiment of the present invention will be described in detail below with reference to FIGS. 7 and 8. Like parts and components in this embodiment are designated by the same reference numerals as those in the first embodiment, and will not be described in detail below.

Figure 7:
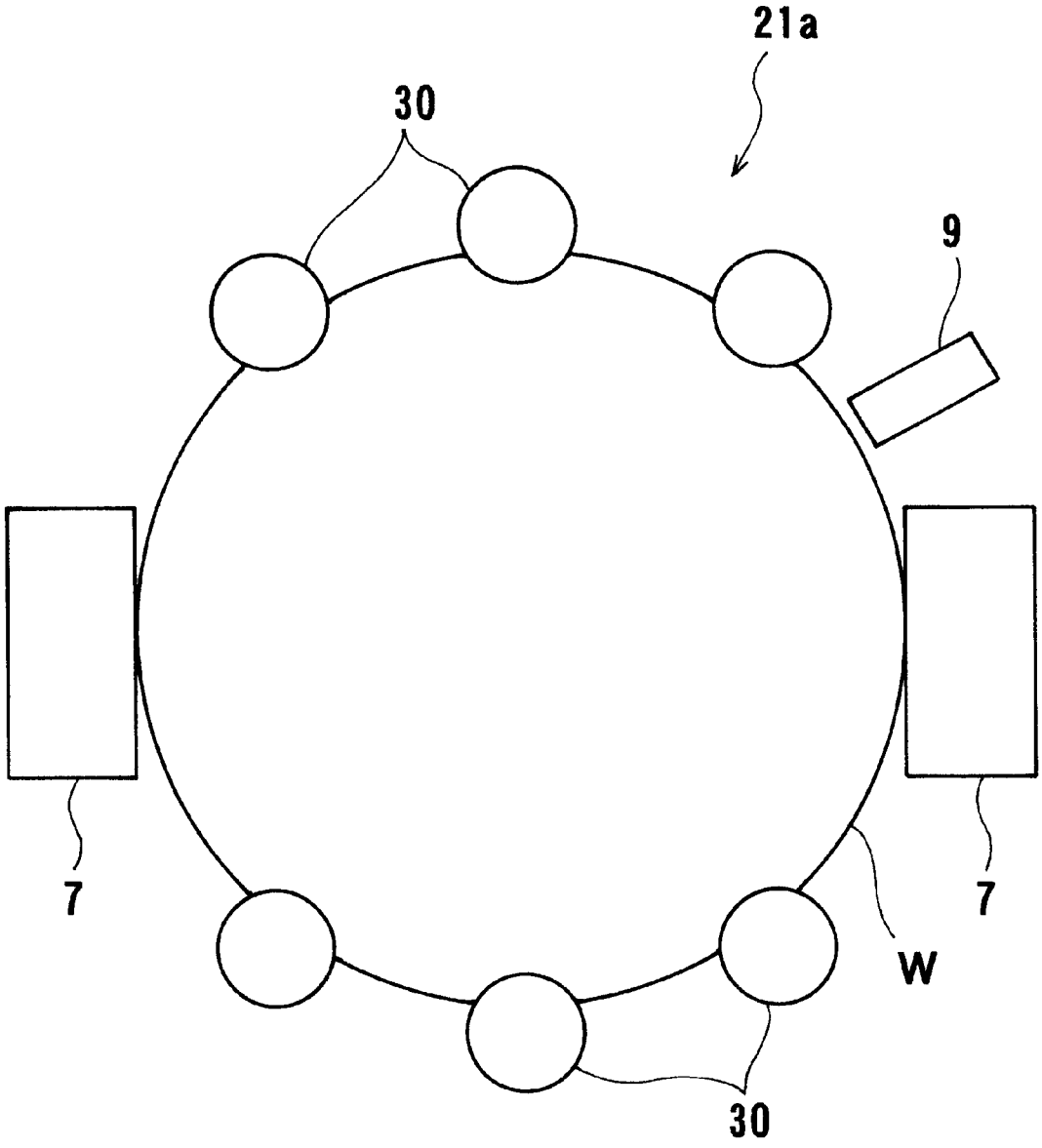
FIG. 7 is a schematic plan view showing a first cleaning unit in a polishing apparatus according to a second embodiment of the present invention.
Figure 8:
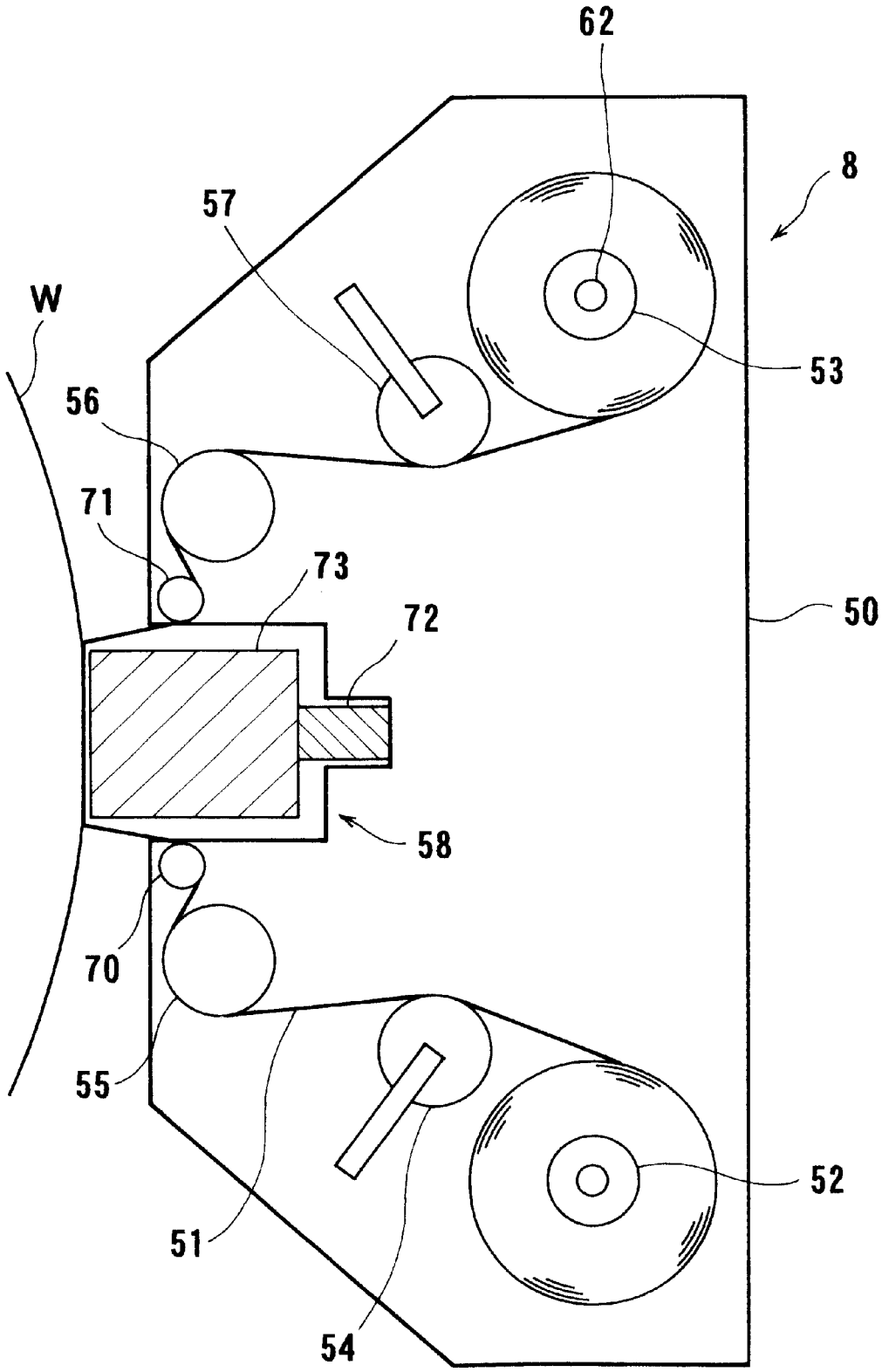
FIG. 8 is a horizontal cross-sectional view showing a cartridge of a tape polishing device in the fist cleaning unit shown in FIG. 7.

FIG. 7 is a schematic plan view showing an arrangement of a first cleaning unit 21*a* in the polishing apparatus according to the second embodiment, and FIG. 8 is a horizontal cross-sectional view showing a cartridge of a tape polishing device in the polishing apparatus. As shown in FIG. 7, the first cleaning unit 21*a* has two tape polishing devices 7. This tape polishing device 7 has a transverse polishing cartridge 8 shown in FIG. 8.

The polishing cartridge 8 has two additional rollers 70, 71 in addition to the rollers 54 through 57. A presser 73 for pressing the polishing tape 51 against the side edge of the substrate W is disposed in the recess 58 formed in the polishing cartridge 8. The presser 73 is biased toward the substrate W by a compression spring 72. The presser 73 and the polishing tape 51 are projected from a side portion of the polishing cartridge 8 toward the substrate W. The polishing cartridge 8 is detachably held by a cartridge holder (not shown), as with the first embodiment.

For polishing the side edge of the substrate W, the presser 73 and the polishing tape 51 projected from the side portion of the polishing cartridge 8 are brought into contact with the side edge of the substrate W, and then the motor of the cartridge holder is energized to rotate the take-up reel 53 in the polishing cartridge 8 for reeling up the polishing tape 51. As a result, while the polishing tape 51 which is being pressed by the presser 73 is brought into sliding contact with the side edge of the substrate W, the polishing tape 51 is reeled up by the take-up reel 53 to polish the side edge of the substrate W with the abrasive particles attached thereon.

In this embodiment, a film thickness sensor 9 for measuring the film thickness on the side edge of the substrate W is disposed adjacent to the tape polishing device 7, as shown in FIG. 7. The film thickness on the side edge of the substrate W is measured with the film thickness sensor 9 during the polishing process, and the end point of the polishing process in which the side edge of the substrate W is polished with the tape polishing device 7 is determined based on the measured film thickness.

While the present invention has been described in detail with reference to the preferred embodiments thereof, it would be apparent to those skilled in the art that many modifications and variations may be made therein without departing from the spirit and scope of the present invention. Next, some possible variations of the embodiment will be described below.

Figure 9:
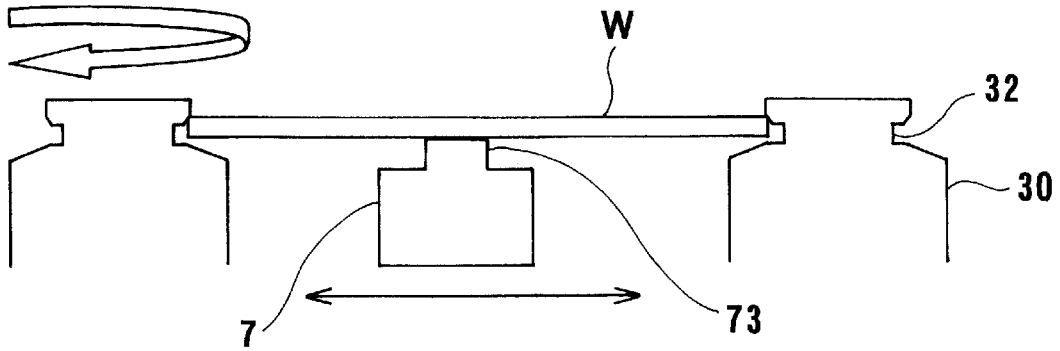
FIG. 9 is a vertical cross-sectional view showing a tape polishing device according to another embodiment of the present invention.

FIG. 9 is a vertical cross-sectional view showing a tape polishing device 7 according to another embodiment of the present invention. As shown in FIG. 9, the tape polishing device 7 has a presser 73 projected upwardly and is disposed below the substrate W. The tape polishing device 7 is horizontally movable below the substrate W. Consequently, the tape polishing device 7 can polish the entire lower surface of the substrate W. On the contrary, the tape polishing device 7 may have a presser projected downwardly and be disposed above the substrate W. In this case, the tape polishing device 7 can be utilized for polishing the upper surface of the substrate W.

Thus, the tape polishing device according to the present invention can polish either the upper or lower surface of the substrate W, and polish even the circuit area of the substrate W. Although a chemical mechanical polishing apparatus has been known as an apparatus for polishing a circuit area of a substrate W, the chemical mechanical polishing apparatus needs a large space to be installed because of the need for a polishing cloth larger than the substrate. The tape polishing device in the polishing apparatus according to the present invention can polish a surface of a substrate with a highly compact structure.

A fluid pressure may be used for pressing the polishing tape 51 against the substrate W, instead of the compression springs 60*a*, 60*b*, 60*c* and the pressers 59*a*, 59*b*, 59*c* shown in FIG. 6. For example, a bladder may be disposed instead of compression springs 60*a*, 60*b*, 60*c* and the pressers 59*a*, 59*b*, 59*c* shown in FIG. 6, and a pressurized fluid such as water or air is supplied into the bladder for pressing the polishing tape 51 against the substrate W by the fluid pressure. Similarly, a bladder having a pressurized fluid therein may be used for pressing the polishing tape 51 against the substrate W, instead of the compression spring 72 and the presser 73 shown in FIG. 8, In the above embodiments, the polishing tape comprises a base film coated with abrasive particles. However, the polishing tape may comprise a strap-like polishing pad such as polyurethane foam or nonwoven fabric which has a width of 5 to 20 mm. In this case, slurry is supplied from the nozzles 33*a*, 33*c*, instead of a chemical liquid.

Figure 10:
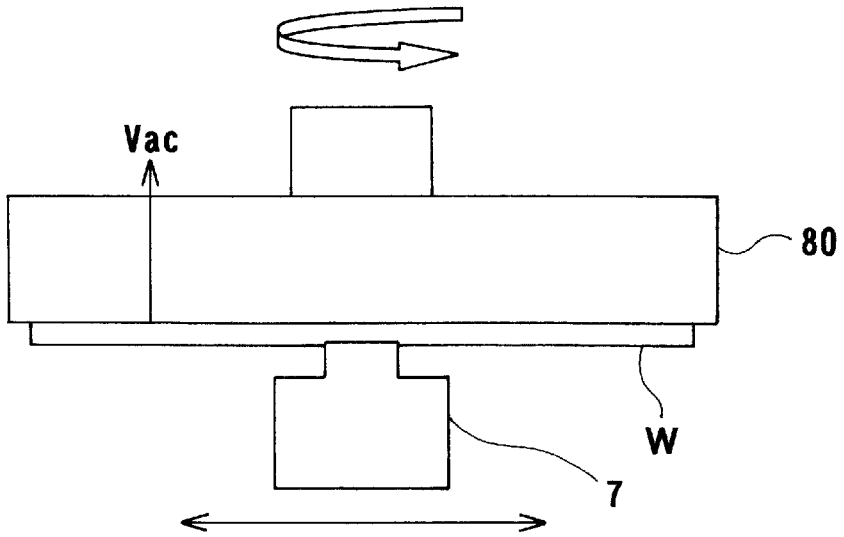
FIG. 10 is a vertical cross-sectional view showing a tape polishing device according to still another embodiment of the present invention.
Figure 11:
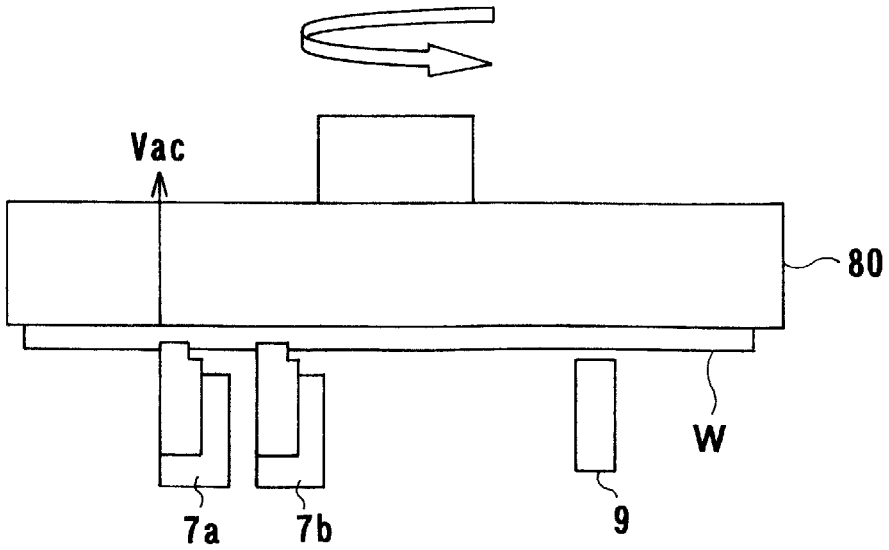
FIG. 11 is a vertical cross-sectional view showing a tape polishing device according to still another embodiment of the present invention.

In the first cleaning unit 21*a*, the rollers 30 are used in order to hold the substrate W. However, in the case where the tape polishing device is disposed beneath the substrate W to polish the lower surface of the substrate W, as shown in FIG. 10, a vacuum chuck 80 may be used for holding the substrate W, and the tape polishing device 7 may receive reaction forces of a load applied to the substrate W by the vacuum chuck 80. Specifically, the upper surface of the substrate W is attracted by the vacuum chuck 80 that is connected to a vacuum source Vac such as a vacuum pump, and hence the substrate W is held by the vacuum chuck 80. In this state, the tape polishing device 7 is positioned below the vacuum chuck 80. In this case, as shown in FIG. 11, a plurality of tape polishing devices 7*a*, 7*b* may be disposed beneath the substrate W. The tape polishing devices 7*a*, 7*b* may have different types of polishing tapes. For example, the tape polishing device 7*a* may use a tape of Imperial Lapping Film #20000, manufactured by 3M, for a final polishing process, and the tape polishing device 7*b* may use a tape of Imperial Lapping Film #4000, manufactured by 3M, for an initial polishing process. Further, after a stock removal polishing is performed with use of the tape polishing device 7*b* for an initial polishing process, a final polishing process may be performed with use of the tape polishing device 7*a* for a final polishing process. In this case, the tape polishing device 7*a* for a final polishing process may be moved so as to follow the movement of the tape polishing device 7*b* for an initial polishing process. Furthermore, a film thickness sensor 9 for measuring the film thickness on the lower surface of the substrate W may be disposed below the substrate W, and the end point of the polishing process in which the substrate W is polished with the tape polishing devices 7*a*, 7*b* may be determined based on the measured film thickness.

With the substrate W being held by the vacuum chuck 80 shown in FIGS. 10 and 11, if circuits are formed on the upper surface of the substrate W, then the circuit area of the substrate W may possibly be brought into contact with the vacuum chuck 80 and hence contaminated by the vacuum chuck 80.

Figure 12:
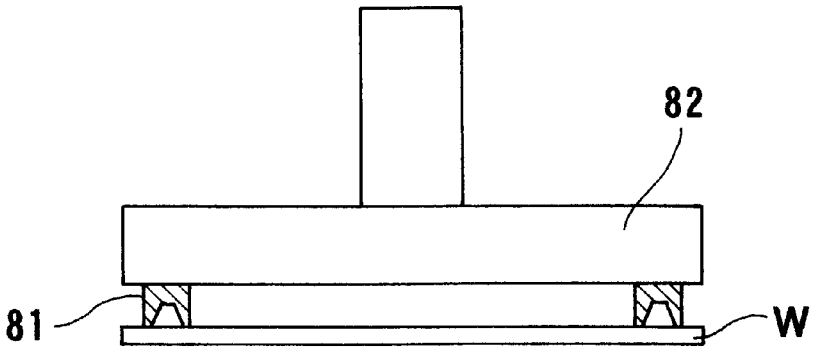
FIG. 12 is a vertical cross-sectional view showing a mechanism for holding a substrate according to another embodiment of the present invention.
Figure 13:
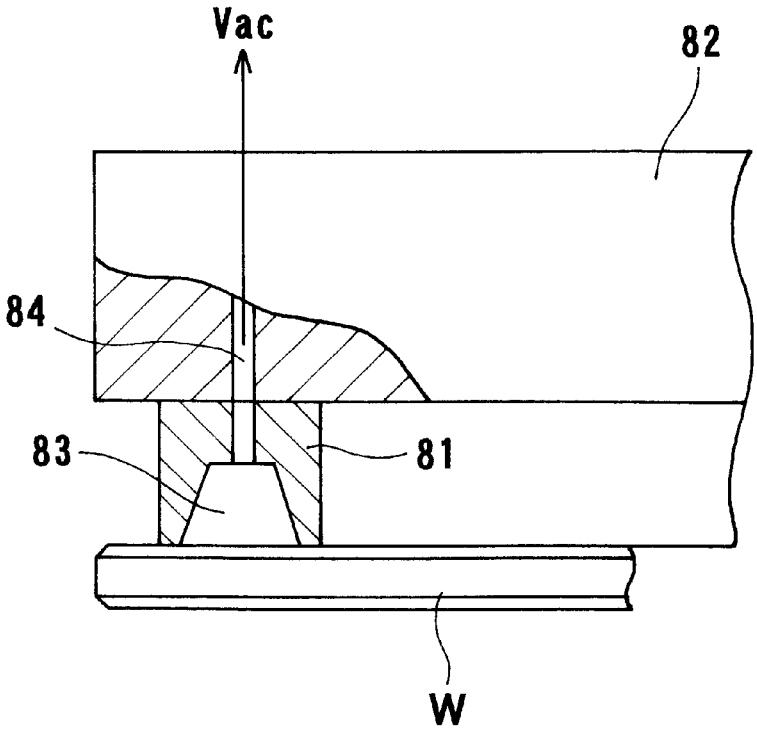
FIG. 13 is an enlarged fragmentary view showing a vacuum seal in the mechanism shown in FIG. 12.

To avoid such a drawback, as shown in FIGS. 12 and 13, it is preferable to hold the substrate W with a vacuum chuck 82 having an annular vacuum seal 81 on the peripheral portion thereof. The vacuum seal 81 comprises an elastic member, such as natural rubber, synthetic rubber, or soft plastic. The vacuum seal 81 has an inner diameter slightly smaller than the outer diameter of the substrate W which is held by the vacuum chuck 82. The vacuum seal 81 has a groove 83 opening downwardly in the form of an inverted V-shape. The groove 83 is connected to a vacuum source Vac such as a vacuum pump via an exhaust passage 84. When a negative pressure is developed in the groove 83 by the vacuum source Vac, the substrate W is held at its peripheral portion by the vacuum chuck 82. Since only the peripheral portion of the substrate W is held in contact with the vacuum chuck 82, the upper surface of the substrate W where the circuits are formed is not contaminated by the vacuum chuck 82.

Figure 14:
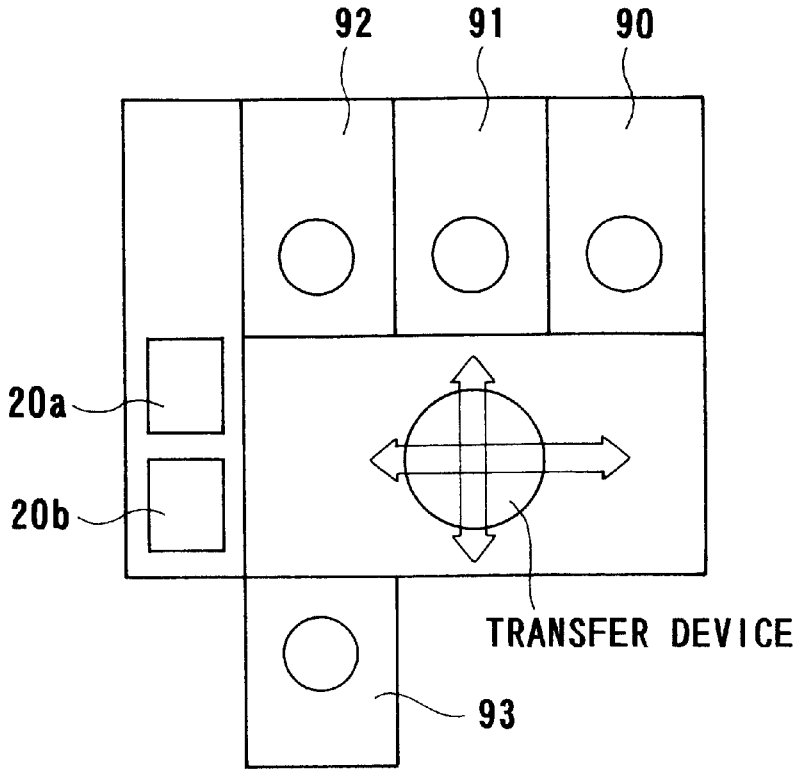
FIG. 14 is a schematic plan view showing an overall general arrangement of a polishing apparatus according to still another embodiment of the present invention.
Figure 15:
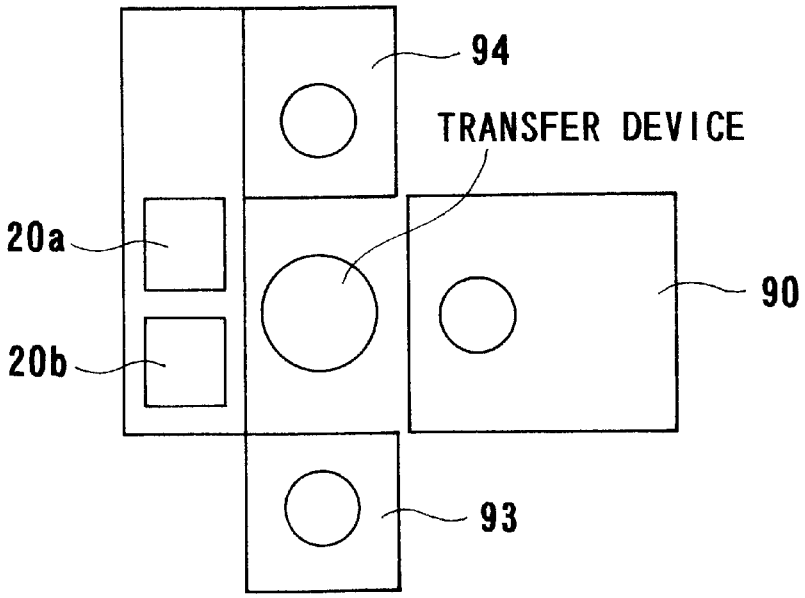
FIG. 15 is a schematic plan view showing an overall general arrangement of a polishing apparatus according to still another embodiment of the present invention.

The layout and number of the units in the polishing apparatus are not limited to the illustrated embodiments, but may be modified. FIG. 14 is a schematic plan view showing another layout of a polishing apparatus. The polishing apparatus shown in FIG. 14 comprises a polishing unit 90 including a tape polishing device as described above, a cleaning unit 91 for cleaning the substrate polished in the polishing unit 90, and a drying unit 92 for drying the substrate cleaned in the cleaning unit 91. These units 90, 91, 92 are disposed in a housing of the polishing apparatus. The polishing apparatus shown in FIG. 14 further comprises an inspection unit 93 for inspecting the polished surface of the substrate which has been polished in the polishing unit 90. This inspection unit 93 is also disposed in the housing of the polishing apparatus. FIG. 15 is a schematic plan view showing still another layout of a polishing apparatus. The polishing apparatus shown in FIG. 15 comprises a polishing unit 90 including a tape polishing device as described above, an inspection unit 93, and a cleaning and drying unit 94. These units 90, 93, 94 are disposed in a housing of the polishing apparatus. The inspection unit 93 may comprise a CCD camera and a computer for performing image processing of an output signal from the CCD camera, or an eddy-current sensor or an optical sensor for measuring the film thickness of the film formed on the substrate. The inspection unit 93 determines whether the substrate has been polished as required, and performs a process depending on the determined results. For example, if the substrate has not been polished as required, then the inspection unit 93 controls the polishing unit 90 to polish the substrate again before the substrate is returned to the loading/unloading unit 20*a* or 20*b*, or changes polishing conditions for feedback in preparation for the polishing of a next substrate. With the inspection unit 93 thus incorporated, the substrate can be polished in accordance with the condition of the polished surface thereof after the substrate has been polished.

Although certain preferred embodiments of the present invention have been shown and described in detail, it should be understood that various changes and modifications may be made therein without departing from the scope of the appended claims.

What is claimed is:

1. A polishing apparatus comprising:

a feed reel operable to feed a polishing tape wound thereon, said polishing tape having a polishing surface;

a take-up reel operable to reel up said polishing tape from said feed reel;

a presser operable to press said polishing tape between said feed reel and said take-up reel against a first surface, to be polished, of a workpiece;

a motor operable to rotate said take-up reel;

a cartridge housing said feed reel, said take-up reel, and said presser therein; and a cartridge holder operable to detachably hold said cartridge.

2. A polishing apparatus according to claim 1, wherein said presser is operable to press said polishing tape against a side edge of the workpiece.

3. A polishing apparatus according to claim 1, wherein said presser is operable to press said polishing tape against a first side of the workpiece.

4. A polishing apparatus according to claim 1, wherein said presser is operable to press said polishing tape against either one of two sides of the workpiece.

5. A polishing apparatus according to claim 1, further comprising:

a cleaning unit operable to clean the polished surface of the workpiece; and a drying unit operable to dry the workpiece which has been cleaned by said cleaning unit.

6. A polishing apparatus according to claim 1, further comprising an inspection unit operable to inspect the first surface of the workpiece.

7. A polishing apparatus according to claim 1, further comprising a vacuum chuck operable to hold the workpiece in such a state that a surface to be polished faces away from said vacuum chuck.

8. A polishing apparatus according to claim 7, wherein said vacuum chuck has a peripheral portion, wherein said vacuum chuck comprises an annular vacuum seal on said peripheral portion, wherein said vacuum seal has a groove, and wherein said groove is configured so as to be in communication with a vacuum source.

9. A polishing apparatus according to claim 1, further comprising a compression spring for biasing said presser toward the workpiece.

10. A polishing apparatus according to claim 1, wherein said presser comprises a bladder and a pressurized fluid supplied into said bladder.

11. A polishing apparatus comprising:

a feed reel operable to feed a polishing tape wound thereon, said polishing tape having a polishing surface;

a take-up reel operable to reel up said polishing tape from said feed reel;

a presser operable to press said polishing tape between said feed reel and said take-up reel against a surface, to be polished, of a workpiece;

a motor operable to rotate said take-up reel;

a cartridge housing said feed reel and said take-up reel, and having a recess in which said presser is disposed; and a cartridge holder operable to detachably hold said cartridge thereon.

12. A polishing apparatus according to claim 11, wherein said recess is configured so as to receive the workpiece.

13. A polishing apparatus according to claim 11, further comprising a cleaning unit operable to clean the polished surface of the workpiece.

14. A polishing apparatus according to claim 11, further comprising a film thickness sensor for measuring a film thickness on the surface of the workpiece.

* * * * *